United States Patent [19]

Domke

[11] 4,260,004

[45] Apr. 7, 1981

[54] CAMERA AND ACCESSORY CASE

[76] Inventor: James G. Domke, 4310 Pine St., Philadelphia, Pa. 19143

[21] Appl. No.: 955,668

[22] Filed: Oct. 27, 1978

[51] Int. Cl.[3] ..... A45C 11/38; B65D 30/22

[52] U.S. Cl. ..... 150/30; 150/52 J; 190/51

[58] Field of Search ..... 150/52 J, 52 R, 28 R, 150/30; 190/51, 1

[56] References Cited

U.S. PATENT DOCUMENTS

| | | | |
|---|---|---|---|
| D. 220,047 | 3/1971 | Fiel | D87/1 R |
| 1,280,430 | 10/1918 | Ensey | 190/51 |
| 2,009,077 | 7/1935 | Walitzky | 150/30 |
| 2,485,028 | 10/1949 | Bauernfreund | 150/52 R |
| 2,624,385 | 1/1953 | Hogan | 150/30 |
| 2,657,726 | 11/1953 | Silverman | 150/30 |
| 2,893,457 | 7/1959 | Wilson | 150/30 |
| 3,217,771 | 11/1965 | Skirow | 150/52 R |
| 3,491,909 | 1/1970 | Ikelheimer | 190/51 |
| 4,078,595 | 3/1978 | Wittelmann | 150/30 |

FOREIGN PATENT DOCUMENTS

| | | | |
|---|---|---|---|
| 595348 | 7/1958 | Italy | 150/30 |
| 961639 | 6/1964 | United Kingdom | 150/52 J |

OTHER PUBLICATIONS

Domke Bag Sales Brochure, Published Nov. 1977.

*Primary Examiner*—Stephen Marcus
*Attorney, Agent, or Firm*—Steele, Gould & Fried

[57] ABSTRACT

A camera bag or the like, including an insert comprising a compartmentalized member having collapsible walls and a bottom and attachment means for selectively securing the collapsible member at a plurality of locations within the bag, each of the compartments of the insert being selectively collapsible notwithstanding the selective attachment of other of the compartments, thereby providing a choice of compartments within the insert and between the insert and the bag.

6 Claims, 6 Drawing Figures

FIG. 4.
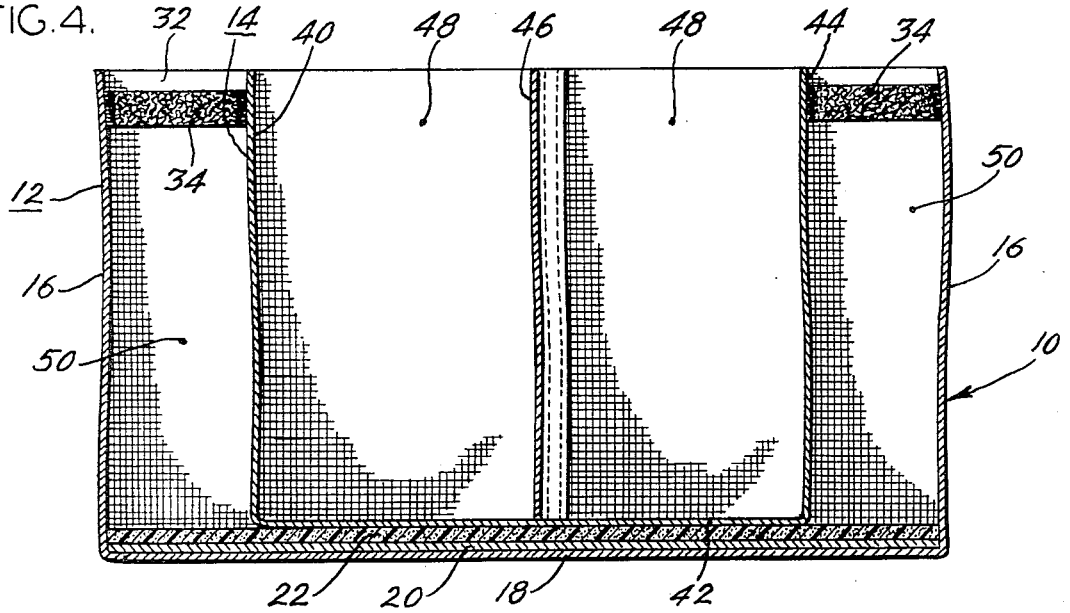
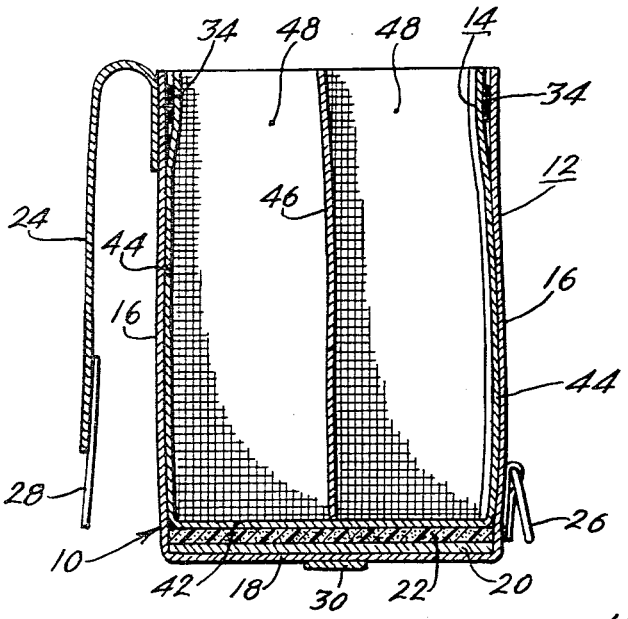
FIG. 5.
FIG. 6.
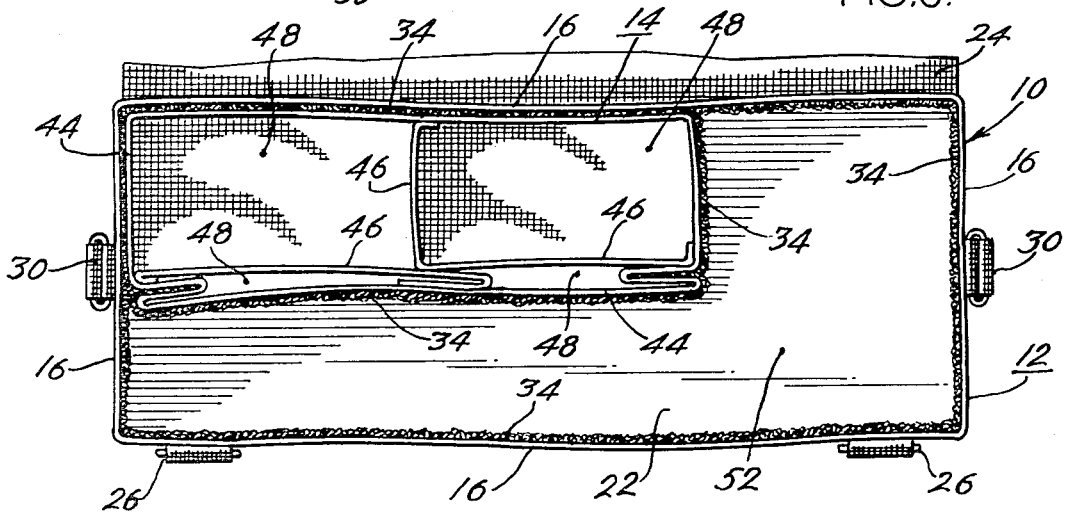

CAMERA AND ACCESSORY CASE

BACKGROUND OF THE INVENTION

1. Field of Invention

This invention relates to the field of camera and accessory cases, often known as gadget bags. In particular, this invention relates to camera and accessory cases having adjustable compartments.

2. Prior Art

Carrying cases are known which have partitioning members for forming compartments of various sizes and shapes. In one such carrying case, the partitioning members are formed from rigid materials and terminate in flanges covered with Velcro hooks. The partitioning members, except for their ends, and the side walls of the case, are all covered with looped fabric. Other such cases are known wherein one or more preformed partition members may be inserted into a larger bag, depending upon the needs of the moment. However, the carrying cases typified by the structure just described have a significant drawback.

The most significant problem with such prior art carrying cases is in dealing with unused partitions or partitioning members. The flexibility of such carrying cases is actually severely limited in that one must arrange the case to carry certain articles for a particular occasion, and either leave the remaining partitions or or partition members at home or in a studio, or one must make further provision for carrying the partitions or partition members along with all of the cameras and camera accessories. There is no flexibility for changing the arrangement of the bag en route or on assignment.

This invention overcomes this significant problem of prior art carrying cases by providing a case having a compartmentalized insert member which is not only selectively attachable at a plurality of locations within the carrying case, but which has selectively collapsible compartments as well.

SUMMARY OF THE INVENTION

It is an object of this invention to provide a carrying case for cameras and accessories, or the like, having adjustable compartments.

It is another object of this invention to provide a carrying case for cameras and accessories, or the like, having an inner, compartmentalized member which is selectively attachable at a plurality of locations within the carrying case.

It is yet another object of this invention to provide a carrying case for cameras and accessories, or the like, having a compartmentalized insert member, the compartments of which have selectively collapsible side walls, partitions and bottoms.

It is a further object of this invention to provide a carrying case for cameras and accessories, or the like, including an insert comprising a compartmentalized collapsible member and attachment means for selectively securing the collapsible member at a plurality of locations within the bag, each of the compartments of the insert member being selectively collapsible notwithstanding the selective attachment of other of said compartments.

It is a still further object of this invention to provide a carrying case for cameras and accessories, or the like, which provides a choice of compartments within an inner compartmentalized collapsible member and between the inner compartmentalized collapsible member and the outer walls of the carrying case.

These, and other objects which will become apparent, are accomplished by a camera and accessory case, or the like, comprising an outer enclosure member including inwardly facing walls defining a compartment, an inner compartmentalized collapsible member, and attachment means mounted on the inwardly facing walls and the inner collapsible member permitting selective securement of the collapsible member at a plurality of locations within the enclosure member, thereby providing a combination of compartments within the collapsible member and between the collapsible member and the outer enclosure member.

In the presently preferred embodiment, the outer enclosure member defines a large rectangular compartment and the inner compartmentalized member defines four smaller rectangular compartments. It has been found that an optimum size relationship between the outer enclosure member and the inner compartmentalized member may be achieved when the inner compartmentalized member is approximately two-thirds the size of the outer enclosure member. Within the inner compartmentalized member, there are preferably four equally sized rectangular compartments. In order to enhance flexibility and convenience, the outer enclosure member and inner compartmentalized member are formed from strong but relatively soft and easily collapsible fabric, such as heavyweight, water resistant canvas. The bottom of the outer enclosure member is reinforced with a relatively stiff structural member, and this relatively rigid structural member is itself covered by a layer of high density foam or other suitable cushioning material.

The selective securement of the inner compartmentalized member is preferably provided by Velcro fastening strips. One-half of a Velcro fastening strip is secured to the inwardly facing walls of the outer enclosure member in a continuous strip near the top of the outer enclosure member. The corresponding half of the Velcro fastening strip is attached to the outwardly facing walls of the inner compartmentalized member, at a position which ensures effective engagement with the fastening strip attached to the inner walls of the outer enclosure member. It is apparent that the inner compartmentalized member may be attached at any location within the outer enclosure member, and that the selected collapse of any particular compartment within the inner member is not hindered by the selected attachment of any other particular compartment.

The entire carrying case, as well as the inner compartmentalized collapsible member is preferably constructed from fabric sections which are stitched together, although other means of attachment, such as adhesives or rivets, may be utilized. Further, the Velcro strips might very well be replaced by respective rows of snaps or buttons.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 4 is a section view taken along the line 4—4 in FIG. 3;

FIG. 5 is a section view taken along the line 5—5 in FIG. 3; and

FIG. 6 is a plan view of an alternative position for the insert member within the outer enclosure member, the insert member being partially collapsed.

DETAILED DESCRIPTION OF THE PREFERRED EMBODIMENT

Figure 1:
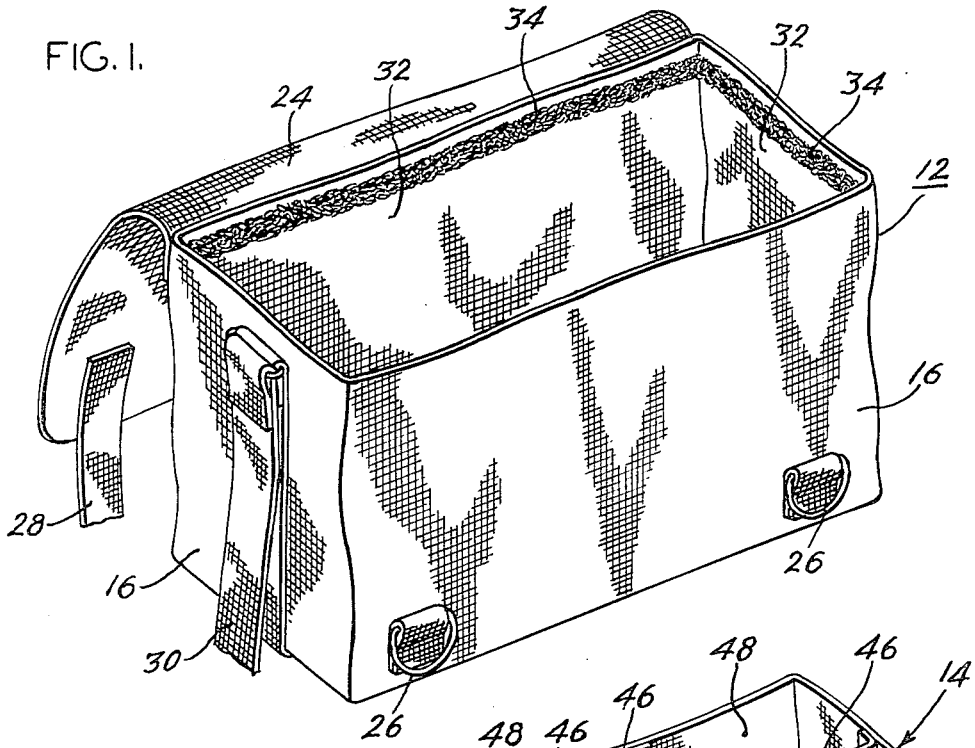
FIG. 1 is a perspective view of an outer enclosure member of a camera and accessory case, or the like, in accordance with this invention.
Figure 2:
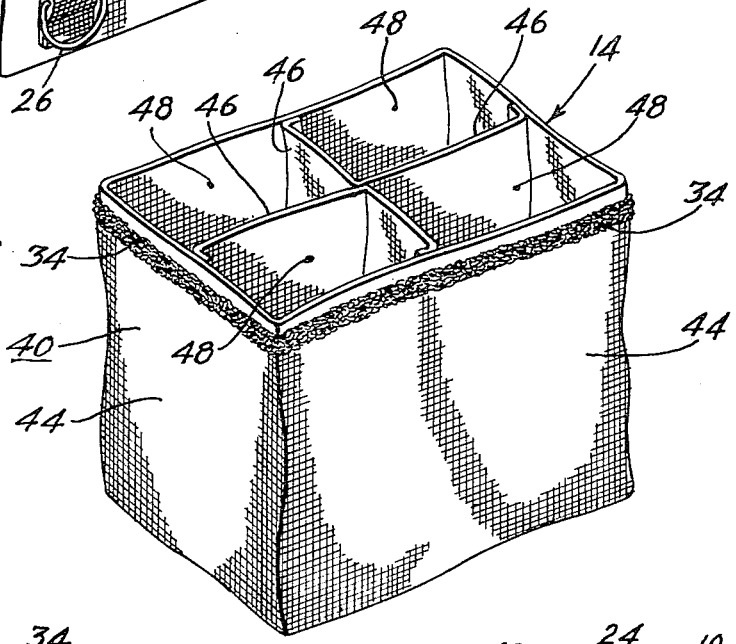
FIG. 2 is a perspective view of an inner, compartmentalized, collapsible insert member of a carrying case for cameras and accessories, or the like, in accordance with this invention.
Figure 3:
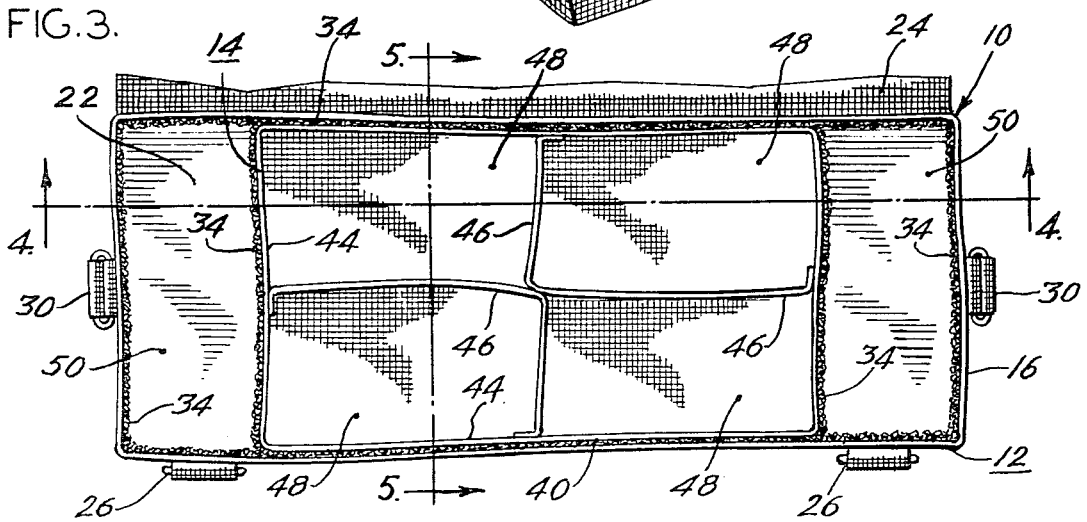
FIG. 3 is a plan view of a carrying case for cameras, accessories, or the like, in accordance with this invention, wherein the insert member shown in FIG. 2 is centrally disposed in the enclosure member shown in FIG. 1.

A carrying case for cameras and accessories, or the like, often referred to as a gadget bag, according to this invention is shown in the figures. With reference to FIGS. 1, 2 and 3, a carrying case or gadget bag 10 comprises an outer enclosure member 12 and an inner compartmentalized collapsible insert member 14. The insert member 14 may be disposed within outer enclosure member 12 at a plurality of positions. Two such positions are shown in FIGS. 3 and 6.

With reference to FIG. 1, the outer enclosure member 12 has side walls 16 and bottom member 18. The bottom of outer enclosure member 12 is provided with a relatively stiff member 20, which may be cardboard, wood, plastic or any other suitable material. The relatively rigid structural member 20 is covered by a layer of high density foam 22 or other suitable cushioning material. In order to be effective, a layer of high density foam need only be approximately ¼" thick. The case is provided with a lid or cover 24, which is secured over the case to rings 26 by straps 28 and suitable clips or fasteners, such as spring clips, not shown. The entire case 10 may be supported by shoulder strap 30.

With reference to FIGS. 2 and 4, the insert 14 is a compartmentalized member having side walls 40, bottom 42 and inner partition walls 46, each of which is collapsible. In the presently preferred embodiment, insert member 14 has four compartments 48 defined by two inner partition walls 46. The inner partition walls 46 are secured to side walls 40 at their ends, and to one another at their point of intersection at or near the center of the insert member.

The outer enclosure member 12 and insert member 14 are preferably made from heavy weight, water resistant canvas. This material is strong, yet light and flexible. With reference to FIG. 6, inasmuch as the walls and bottom are collapsible in all directions, that is, longitudinally, laterally and diagonally any one or all of the compartments 48 are selectively collapsible. Other similar materials could be suitable. Inasmuch as the carrying case 10 is preferably formed from a fabric material, construction is generally by stitching wherever necessary, although other attachment means, such as adhesives or rivets, might also be utilized.

Attachment means 34 are provided for the selective securement of the inner compartmentalized member 14 within outer enclosure member 12. In outer enclosure member 12, attachment means 34 are preferably mounted in a continuous strip near the top of the four inwardly facing walls 32. On insert member 14, the attachment means are disposed near the top of the four outwardly facing walls 44. In the presently preferred embodiment, attachment means 34 are Velcro fastening strips, although other suitable detachable securement means, such as snaps or buttons, might also be utilized.

With reference to FIG. 3, insert member 14 is substantially centrally disposed within outer enclosure member 12. This arrangement provides four larger rectangular compartments 48 within insert member 14 and two smaller rectangular compartments 50 formed between insert member 14 and the inwardly facing walls 32 of outer enclosure member 12.

The selective securement and selective collapsibility of the compartments 48 of insert member 14 are shown in FIG. 6, wherein insert member 14 is secured in one corner of outer enclosure member 12, and the two lower compartments 48 are collapsed, with respect to the orientation of FIG. 6. In this example, the lower halves of the left and right side walls are collapsed, together with the lower half of the bottom. If instead, the two right compartments are collapsed, the right halves of the upper and lower side walls will collapse, together with the right half of the bottom. Accordingly, the bottom is longitudinally, laterally and diagonally collapsible. This arrangement provides two smaller rectangular compartments and one very large L-shaped compartment 52. In view of the fact that any particular compartment 48 is selectively collapsible notwithstanding selective attachment of any one or more of the other compartments 48, there is effectively an unlimited choice of the number, size and shape of compartments which can be made available within the outer enclosure member 12. The fact that insert member 14 has selectively collapsible compartments results in the capability of always having compartments available if needed, while at the same time, providing the capability of collapsing compartments out of the way when not needed. All of this is accomplished without any rigid partitioning members, which must be separately stored or inconveniently carried when not used.

The present invention may be embodied in other specific forms without departing from the spirit or essential attributes thereof, and, accordingly, reference should be made to the appended claims rather than to the foregoing specification as indicating the scope of the invention.

What is claimed is:

1. A camera and accessory case, or the like, comprising:

an outer enclosure member including inwardly facing walls defining a compartment;

a removable, collapsible, inner compartmentalized member having walls and a bottom, the bottom being collapsible longitudinally, laterally and diagonally; and, attachment means mounted on said inwardly facing walls and said inner collapsible member providing selective securement of said collapsible member at a plurality of locations within said enclosure member, thereby providing a combination of compartments within said collapsible member and between the walls of said collapsible member and the walls of said outer enclosure member.

2. A camera and accessory case, or the like, comprising:

an outer enclosure member including inwardly facing walls defining a compartment, at least some of said inwardly facing walls including attachment means for securing further structure thereto; and an inner collapsible compartmentalized member having attachment means for selective securement to said inwardly facing walls at a plurality of locations, said inner compartmentalized member having collapsible walls and a bottom to provide a combination of compartments within said compartmentalized member and between said compartmentalized member and said outer enclosure member.

3. The case of claims 1 or 2, wherein the compartments of the inner member are selectively collapsible notwithstanding the attachment of the walls of other of the compartments to the inwardly facing walls of the outer enclosure member.

4. The case of claims 1 or 2, wherein any one and any combination of compartments in said compartmentalized member is selectively collapsible.

5. The case of claims 1 or 2, wherein said attachment means is Velcro fastening strips.

6. The case of claims 1 or 2, wherein said compartmentalized member and said outer enclosure member are canvas fabric.

* * * * *